US010972839B2

(12) United States Patent
Tseng et al.

(10) Patent No.: US 10,972,839 B2
(45) Date of Patent: Apr. 6, 2021

(54) HEAD BAND STRUCTURE OF HEADSET

(71) Applicant: Cheng Uei Precision Industry Co., Ltd., New Taipei (TW)

(72) Inventors: Chi Ming Tseng, New Taipei (TW); Chin Chung Lin, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 9 days.

(21) Appl. No.: 16/706,896

(22) Filed: Dec. 9, 2019

(65) Prior Publication Data

US 2021/0051408 A1 Feb. 18, 2021

(30) Foreign Application Priority Data

Aug. 15, 2019 (CN) ..... 201921328204.2

(51) Int. Cl.
*H04R 5/033* (2006.01)
*H04R 1/10* (2006.01)

(52) U.S. Cl.
CPC ..... *H04R 5/0335* (2013.01); *H04R 1/1066* (2013.01)

(58) Field of Classification Search
CPC ..... H04R 5/0335; H04R 1/1066
See application file for complete search history.

(56) References Cited

FOREIGN PATENT DOCUMENTS

CN 208940168 U * 6/2019

OTHER PUBLICATIONS

Xiong, Google Translation of CN208940168U, "A kind of stretching structure of headphone". 2019 (Year: 2019).*

* cited by examiner

*Primary Examiner* — Regina N Holder
(74) *Attorney, Agent, or Firm* — Lin & Associates Intellectual Property, Inc.

(57) ABSTRACT

A head band structure of headset includes a retractable adjusting block and a head band group. The retractable adjusting block includes an upper cover, a sliding slice, an elastic piece and a lower cover. The sliding slice has at least one blocking portion. A substantial middle of the elastic piece is arched upward to form a convex surface. The head band group is connected with the retractable adjusting block. The head band group has a head band, and two end covers disposed to two opposite ends of the head band. A surface of each end cover has a waveform locking portion, and at least one stopping frame disposed at one end of the waveform locking portion. The convex surface keeps contacting with the waveform locking portion.

16 Claims, 10 Drawing Sheets

HEAD BAND STRUCTURE OF HEADSET

CROSS-REFERENCE TO RELATED APPLICATION

The present application is based on, and claims priority from, China Patent Application No. 201921328204.2, filed Aug. 15, 2019, the disclosure of which is hereby incorporated by reference herein in its entirety.

BACKGROUND OF THE INVENTION

1. Field of the Invention

The present invention generally relates to a headset, and more particularly to a head band structure of headset.

2. The Related Art

Currently, types of headphones include earphones, ear canal earphones, headsets and so on. Comparing with other type headphone, the headset can cover ears fully. A wearing feeling of the headset is comfortable, and the headset has a head band structure. A length of the head band is capable of being adjusted by virtue of adjusting the head band structure to appropriate for needs of different users.

A Chinese mainland patent with publication number of 208940168 discloses a telescopic structure of headset which is a head band structure of headset, The telescopic structure of headset includes a cover, and a telescopic element slidably connected with the cover. The cover includes an upper cover and a lower cover. The lower cover has a sliding groove matched with the telescopic element. The telescopic element is slidably assembled in the sliding groove. Several portions of a bottom wall of the sliding groove protrude upward to form a plurality of protruding blocks spaced from one another. Each two adjacent protruding blocks are spaced from each other to form a buckling groove therebetween. The telescopic element includes a head band, a retractable part and an elastic piece. The head band is fastened to a top of the retractable part. The elastic piece is clamped between the head band and the retractable part. The elastic piece has a convex portion, a buffer portion and a hooking portion. The retractable part has a penetrating groove and an assembling block. The convex portion passes through the penetrating groove. The assembling block appropriates for the hooking portion. The convex portion projects out of the penetrating groove, and the convex portion is buckled in the buckling groove. The hooking portion hooks the assembling block. A top surface of the buffer portion abuts against a bottom surface of the head band. The retractable part has a limiting hook for limiting a largest height between the head band and the retractable part. An outer side wall of the head band abuts against an inner side wall of the limiting hook.

However, the elastic piece of the above-mentioned telescopic structure of headset is fastened between the head band and the retractable part, the elastic piece is fastened and immovable, and the elastic piece slides by an assembling structure of the upper upper cover and the lower cover to make the head band reach a retractable and adjustable function.

Thus, an innovative head band structure of headset is essential to be provided to make the head band structure of the headset retractable and adjustable.

SUMMARY OF THE INVENTION

An object of the present invention is to provide a head band structure of headset. The head band structure of headset includes a retractable adjusting block and a head band group. The retractable adjusting block includes an upper cover, a sliding slice, an elastic piece and a lower cover. The elastic piece is disposed to one end of the lower cover. The upper cover is disposed on the lower cover. The sliding slice is disposed between the lower cover and the upper cover. The sliding slice has at least one blocking portion. A substantial middle of the elastic piece is arched upward to form a convex surface. The head band group is connected with one end of the retractable adjusting block. The head band group has a head band, and two end covers disposed to two opposite ends of the head band. A gap is formed between each end cover and the head band to make the one end of the retractable adjusting block slide in the gap. An inner surface of the head band is recessed inward to form two sliding grooves. A surface of each end cover faces one sliding groove has a waveform locking portion, and at least one stopping frame disposed at one end of the waveform locking portion. The convex surface keeps contacting with the waveform locking portion. When the head band structure of headset is retracted, a movable distance of the at least one blocking portion is generated between the at least one stopping frame of one end cover and one end of the surface of the one end cover away from the at least one stopping frame of the one end cover, when the head band structure of headset is pulled out, the at least one blocking portion contacts with an inner end of the at least one stopping frame facing the at least one blocking portion.

Another object of the present invention is to provide a head band structure of headset. The head band structure of headset includes a retractable adjusting block and a head band group. The retractable adjusting block includes a lower cover, an elastic piece disposed to the lower cover, an upper cover disposed on the lower cover, and a sliding slice disposed between the lower cover and the upper cover. The sliding slice has at least one blocking portion. A substantial middle of the elastic piece is arched upward to form a convex surface. The head band group receives one end of the retractable adjusting block. An inner surface of the head band group has a waveform locking portion, and at least one stopping frame disposed at one end of the waveform locking portion. The convex surface keeps contacting with the waveform locking portion. When the head band structure of headset is retracted towards an inside of the head band group, a movable distance of the at least one blocking portion is generated between the at least one stopping frame and one end of the inner surface of the head band group away from the at least one stopping frame, when the head band structure of headset is pulled out from the head band group, the at least one blocking portion contacts with the at least one stopping frame.

Another object of the present invention is to provide a head band structure of headset. The head band structure of headset includes a head band group and a retractable adjusting block. The head band group has a head band, and two end covers disposed to two opposite ends of the head band. A gap is formed between each end cover and the head band to make one end of the retractable adjusting block slide in the gap. Two opposite ends of an inner surface of the head band are recessed inward to form two sliding grooves. A surface of each end cover facing one sliding groove has a waveform locking portion, and at least one stopping frame disposed at one end of the waveform locking portion. The retractable adjusting block telescopically connected with one end of the head band group, includes a cover assembly, a sliding slice disposed in the cover assembly and having at least one blocking portion, and an elastic piece disposed to one end of the cover assembly. A substantial middle of the elastic piece is arched upward to form a convex surface. When the head band structure of headset is retracted, a movable distance of the at least one blocking portion is generated between the at least one stopping frame of one end cover and one end of the surface of the one end cover away from the at least one stopping frame of the one end cover, when the head band structure of headset is pulled out, the at least one blocking portion contacts with an inner end of the at least one stopping frame facing the at least one blocking portion, the convex surface keeping contacting with the waveform locking portion.

As described above, when the retractable adjusting block is adjusted, the protruding portion of the lower cover rubs against a corresponding mechanism of the head band group, a pushing force generated at the time of the retractable adjusting block sliding will be decomposed into a friction force and a positive force, the positive force is transmitted to the elastic piece by a structure of the head band structure of headset, so that the convex surface of the elastic piece keeps contacting with the waveform locking portion of the one end cover, and a buckling point between the convex surface of the elastic piece and the waveform locking portion of the one end cover of the head band group is obvious and has a better touching feeling. The elastic piece is disposed to the retractable adjusting block, when the retractable adjusting block slides, the elastic piece moves simultaneously. Furthermore, when the head band structure of headset is retracted, the convex surface of the elastic piece keeps contacting with the waveform locking portion of the one end cover, the movable distance of the two blocking portions is generated between the two hollow stopping frames of the one end cover and the one end of the surface of the one end cover away from the two hollow stopping frames of the one end cover, the movable distance of the two blocking portions is the adjusting scope of pulling out the retractable adjusting block, when the head band structure of headset is pulled out, the convex surface of the elastic piece keeps contacting with the waveform locking portion of the one end cover, at the moment, the two blocking portions contact with the inner ends of the two stopping frames facing the two blocking portions, the retractable adjusting block has no way of being pulled out to make the retractable adjusting block be pulled to the furthest position distanced from the head band group. As a result, the head band structure of headset is retractable and adjustable.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
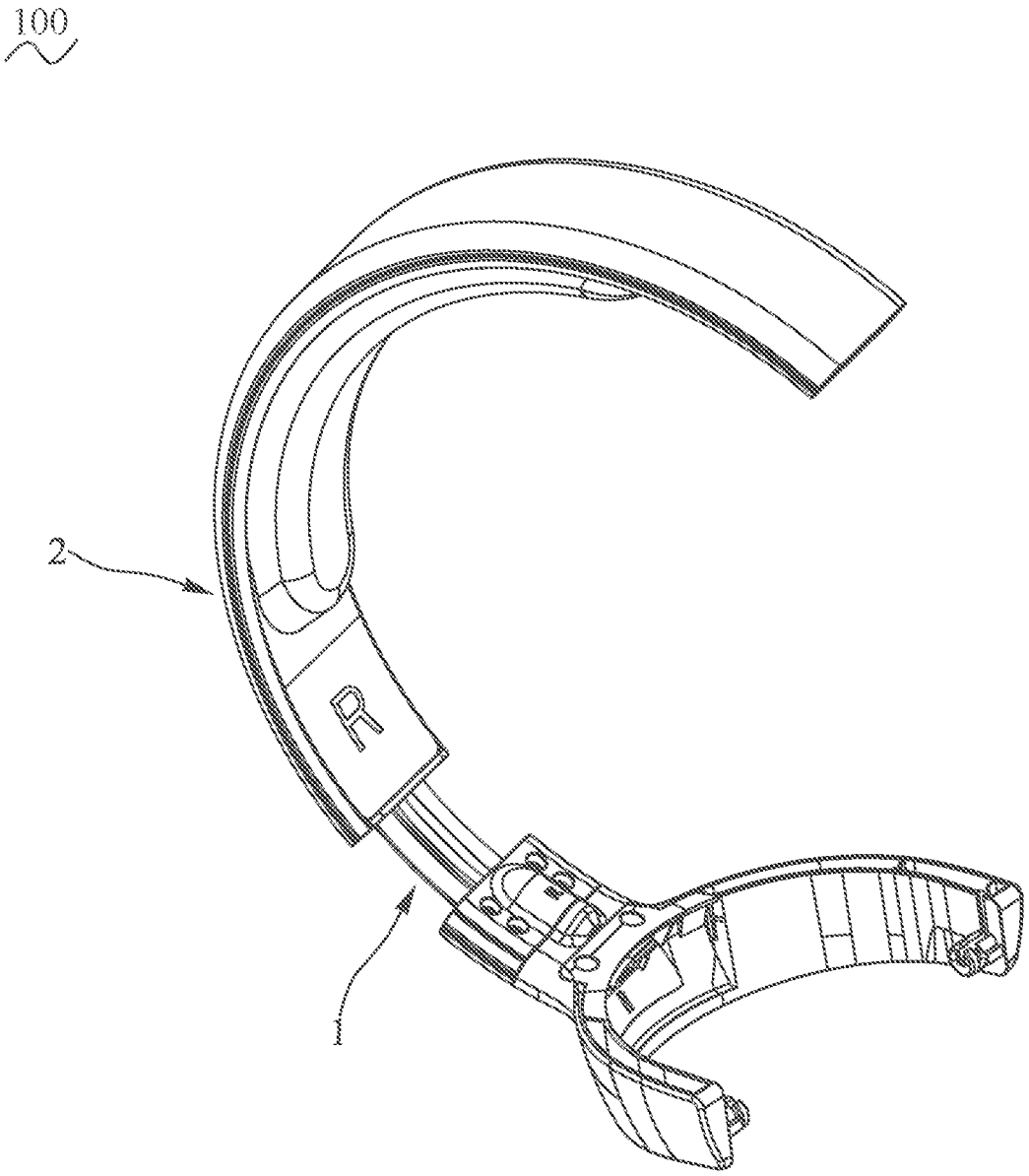
FIG. 1 is a perspective view of a head band structure of headset in accordance with a preferred embodiment of the present invention.
Figure 2:
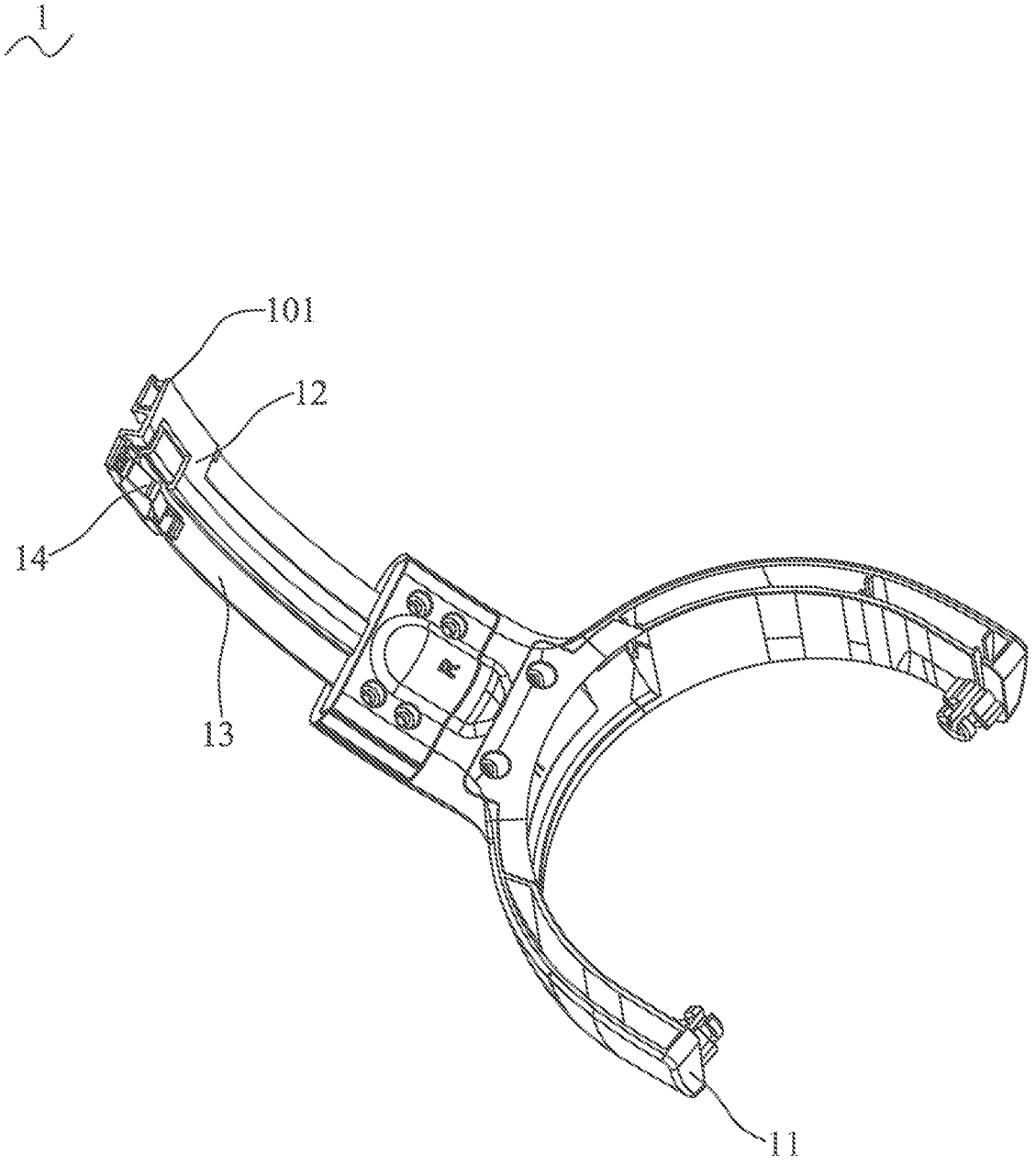
FIG. 2 is a perspective view of a retractable adjusting block of the head band structure of headset of FIG. 1.
Figure 3:
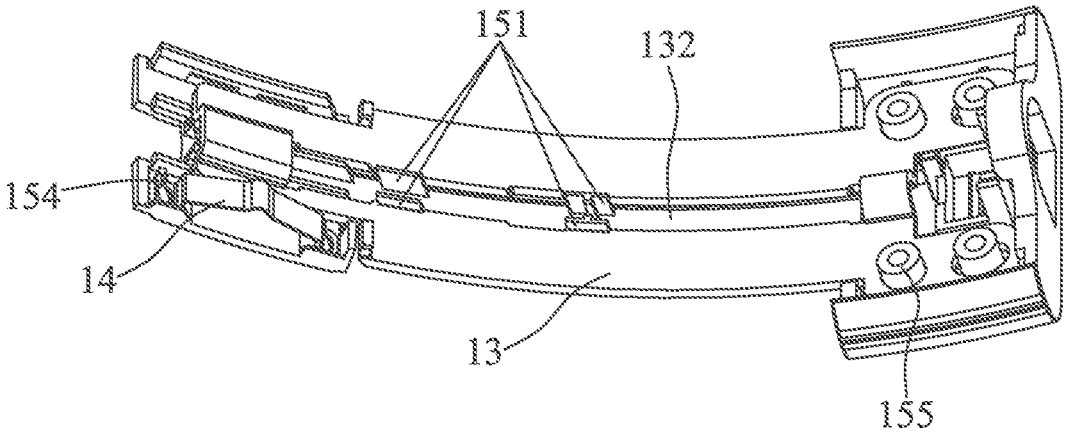
FIG. 3 is a partially perspective view of the retractable adjusting block of the head band structure of headset of FIG. 1.
Figure 4:
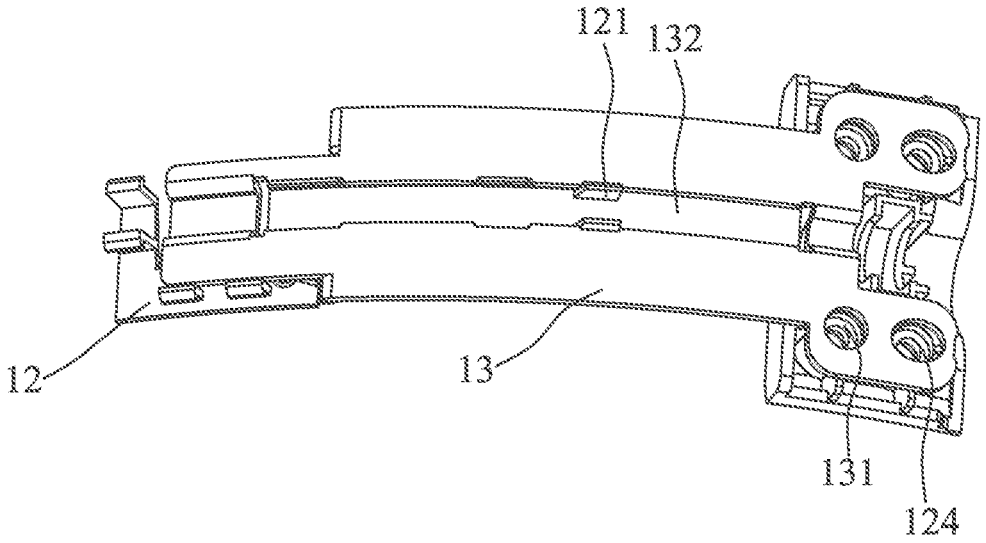
FIG. 4 is another partially perspective view of the retractable adjusting block of the head band structure of headset of FIG. 1.
Figure 5:
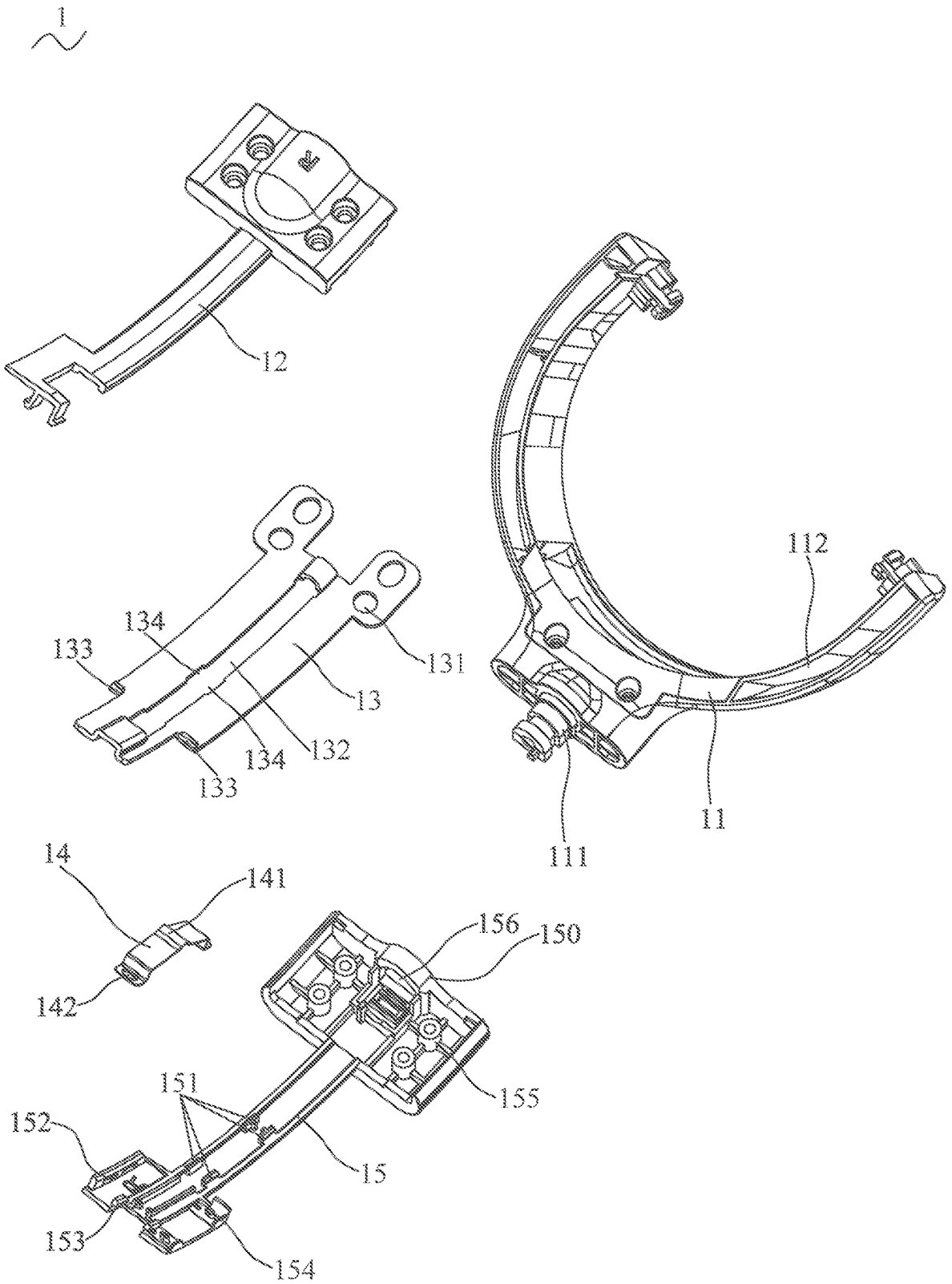
FIG. 5 is an exploded view of the retractable adjusting block of the head band structure of headset of FIG. 1.
Figure 6:
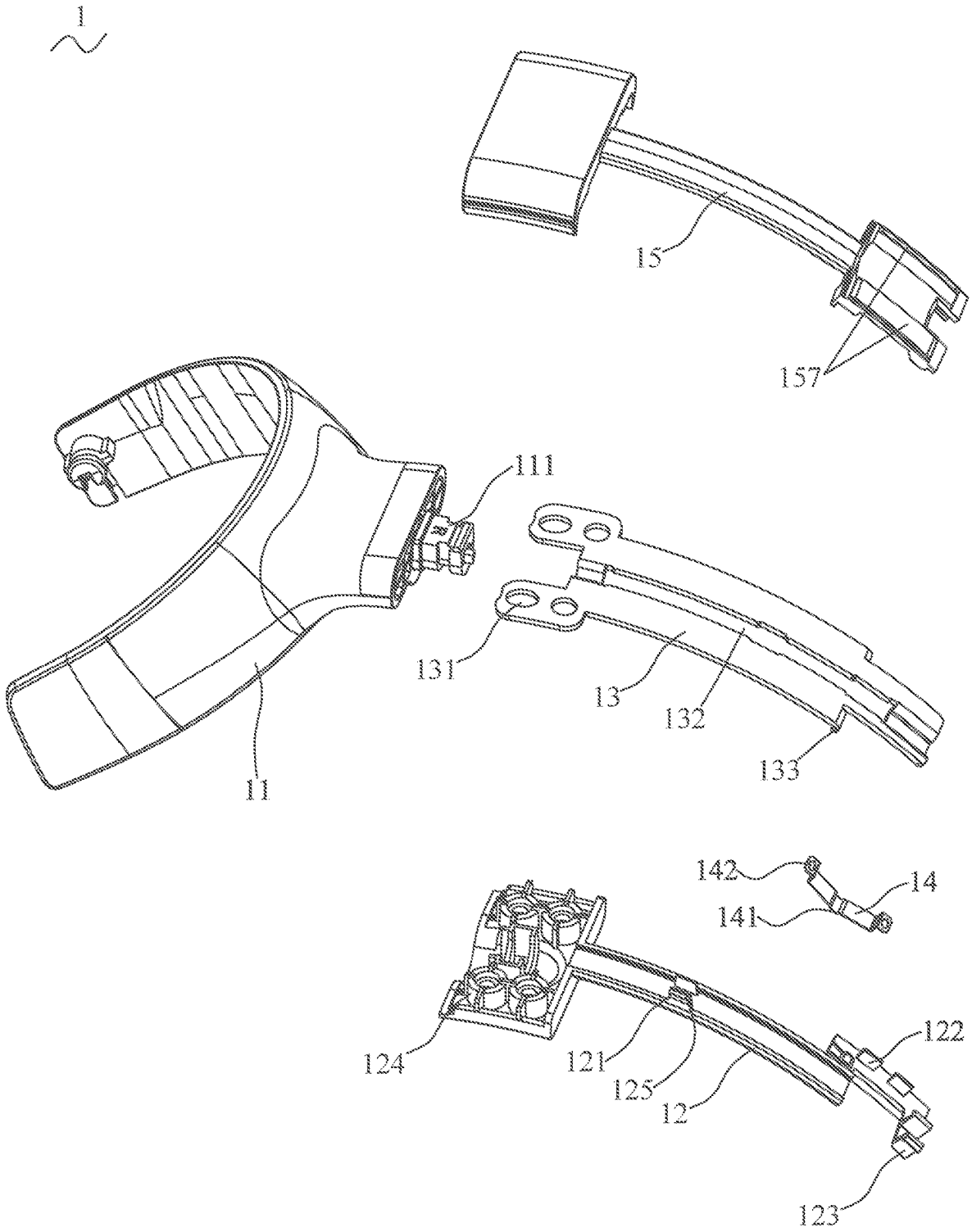
FIG. 6 is another exploded view of the retractable adjusting block of the head band structure of headset of FIG. 1.

With reference to FIG. 1, a head band structure of headset 100 in accordance with a preferred embodiment of the present invention is shown. The head band structure of headset 100 includes a retractable adjusting block 1, and a head band group 2 receiving and connected with one end of the retractable adjusting block 1. The retractable adjusting block 1 is telescopically connected with one end of the head band group 2. The one end of the retractable adjusting block 1 is received in the head band group 2.

Referring to FIG. 2 to FIG. 6, the retractable adjusting block 1 includes a bracket 11, a cover assembly 101, a sliding slice 13 and an elastic piece 14. The cover assembly 101 includes an upper cover 12 and a lower cover 15. The bracket 11 has an arc-shaped holding portion 112, and a connecting shaft 111 protruded rearward from a middle of a rear of the holding portion 112. A middle of the lower cover 15 is slightly arched downward. The elastic piece 14 is disposed to one end of the cover assembly 101. The elastic piece 14 is disposed to one end of the lower cover 15. A middle of the other end of the lower cover 15 has a fastening portion 150 matched with the connecting shaft 111. The connecting shaft 111 passes through the fastening portion 150 of the lower cover 15 for realizing a fixation between the bracket 11 and the lower cover 15. A middle of the sliding slice 13 is slightly arched downward and is matched with the lower cover 15. The sliding slice 13 is disposed in the cover assembly 101. The sliding slice 13 is disposed between the lower cover 15 and the upper cover 12. The sliding slice 13 is placed in the lower cover 15, and the sliding slice 13 is fastened with and buckled with the lower cover 15. The upper cover 12 is disposed on and is buckled with the lower cover 15. In the preferred embodiment, the retractable adjusting block 1 is a compound material. The retractable adjusting block 1 has a better structure tenacity and a structure strength. The upper cover 12 and the lower cover 15 are of plastic materials, and the sliding slice 13 is made of metal material.

The upper cover 12 has two first buckling hooks 121, two second buckling hooks 122 and two third buckling hooks 123, and a plurality of multilayer holes 124. A front of the sliding slice 13 opens a plurality of through-holes 131, and has a fixing area 132 and at least one blocking portion 133. In the preferred embodiment, the front of the sliding slice 13 has two spaced blocking portions 133. A substantial middle of the elastic piece 14 is arched upward to form a convex surface 141. The elastic piece 14 opens a plurality of locating holes 142. The convex surface 141 is located among the plurality of the locating holes 142. In the preferred embodiment, the elastic piece 14 opens two locating holes 142. The convex surface 141 is located between the two locating holes 142. Each locating hole 142 is of an oval shape. The lower cover 15 has a plurality of fourth buckling hooks 151, two first buckling grooves 152 disposed behind the plurality of the fourth buckling hooks 151, a second buckling groove 153 opposite to the two first buckling grooves 152, a plurality of locating pillars 154 opposite to the two first buckling grooves 152, a plurality of hollow fixing pillars 155 disposed to a front end of the lower cover 15, a fastening hole 156 disposed in front of the plurality of the hollow fixing pillars 155, and a protruding portion 157 protruded rearward from a top end of a rear surface of the lower cover 15. Two opposite sides of the top end of the rear surface of the lower cover 15 protrude rearward to form two protruding portions 157. In the preferred embodiment, the lower cover 15 has two locating pillars 154.

The two second buckling hooks 122 and the two third buckling hooks 123 are disposed to one end of an inner surface of the upper cover 12 facing the sliding slice 13. The plurality of the multilayer holes 124 are formed in the other end of the inner surface of the upper cover 12. Outer portions of tops of the two first buckling hooks 121 protrude outward to form two blocking portions 125. The two first buckling hooks 121 are disposed at a middle portion of the inner surface of the upper cover 12. The second buckling groove 153 is formed on one end of an inner surface of the lower cover 15 facing the sliding slice 13. The plurality of the locating pillars 154 and the two first buckling grooves 152 are disposed on the one end of the inner surface of the lower cover 15. The second buckling groove 153 is disposed between the plurality of the locating pillars 154 and the two first buckling grooves 152. The fastening hole 156 is formed at the other end of the inner surface of the lower cover 15. The protruding portion 157 is disposed to one end of an outer surface of the lower cover 15 opposite to the one end of the inner surface of the lower cover 15. The protruding portion 157 is disposed between the head band 2 and one end cover 22. The plurality of the hollow fixing pillars 155 are disposed on the other end of the inner surface of the lower cover 15.

The plurality of the hollow fixing pillars 155 are disposed adjacent to two opposite sides of the fastening hole 156. The plurality of fourth buckling hooks 151 are disposed on a middle of the inner surface of the lower cover 15. A tail end of the sliding slice 13 is narrower than two opposite sides of a front of the sliding slice 13. Rear edges of the two opposite sides of the front of the sliding slice 13 are bent inward opposite to the lower cover 15 to form two blocking portions 133. The two blocking portions 133 are disposed to one end of the sliding slice 13. The two blocking portions 133 are bent towards the upper cover 12. The plurality of the through-holes 131 are formed in the other end of the sliding slice 13. A middle of the sliding slice 13 is hollow. The fixing area 132 is formed in the middle of the sliding slice 13. In the preferred embodiment, the fixing area 132 is a slot longitudinally extending along the sliding slice 13 and arched towards the lower cover 15. Several portions of two facing inner surfaces of two side walls of the fixing area 132 are recessed oppositely to form a plurality of recesses 134. In the preferred embodiment, two portions of an inner surface of one side wall and two portions of an inner surface of the other side wall of the fixing area 132 are recessed oppositely to form four recesses 134. The plurality of the recesses 134 are corresponding to the plurality of the fourth buckling hooks 151.

The plurality of the fourth buckling hooks 151 are buckled in the plurality of the recesses 134 of the fixing area 132 for realizing a fixation between the sliding slice 13 and the lower cover 15. The two first buckling hooks 121 are buckled in the fixing area 132 for realizing a fixation between the upper cover 12 and the sliding slice 13. A distance between the plurality of the fourth buckling hooks 151 and the head band group 2 is smaller than a distance between the two first buckling hooks 121 and the head band group 2. The plurality of the blocking portions 125 abut against a top surface of the sliding slice 13. A distance between the two first buckling hooks 121 and the bracket 11 is smaller than a distance between the plurality of the fourth buckling hooks 151 and the bracket 11, so the two first buckling hooks 121 are nearer to the bracket 11. The plurality of the fourth buckling hooks 151 and the two first buckling hooks 121 buckle the two side walls of the fixing area 132. The two second buckling hooks 122 are buckled in and fastened in the two first buckling grooves 152 for realizing a fixation and location between the upper cover 12 and the lower cover 15. The two third buckling hooks 123 are buckled in and fastened in the second buckling groove 153 for realizing a location and fixation between the upper cover 12 and the lower cover 15. The plurality of the hollow fixing pillars 155 pass through the plurality of the through-holes 131, and then the plurality of the hollow fixing pillars 155 are inserted into the plurality of multilayer holes 124 for realizing a fixation and location between the upper cover 12, the sliding slice 13 and the lower cover 15. The two blocking portions 133 is used for confirming whether the two blocking portions 133 contact with a corresponding mechanism of the head band group 2 so as to distinguish whether the head band structure of headset 100 reaches a largest stretching distance of the head band structure of headset 100.

In the preferred embodiment, each locating hole 142 is a perforation and is of a elliptical shape. Each locating pillar 154 is of an oblique column slantwise extended downward and inward. After the plurality of the locating pillars 154 pass through the plurality of the locating holes 142 of the elastic piece 14, when an external force is exerted on the convex surface 141, the plurality of the locating pillars 154 fastens the elastic piece 14 to prevent the elastic piece 14 from falling off. The two locating pillars 154 pass through the two locating holes 142. Each locating pillar 154 is located in one locating hole 142. A manufacturing procedure of the elastic piece 14 is decreased by way of the elastic piece 14 being fastened to the plurality of the locating pillars 154, so that a cost of the head band structure of headset 100 is lowered.

The fastening hole 156 of the lower cover 15 is connected with the connecting shaft 111 for realizing a location and fixation between the lower cover 15 and the bracket 11. In the preferred embodiment, when the retractable adjusting block 1 slides, the protruding portion 157 of the lower cover 15 rubs against the corresponding mechanism of the head band group 2, a pushing force of the retractable adjusting block 1 will be decomposed into a friction force and a positive force, the positive force is transmitted to the elastic piece 14 by virtue of a structure conduction, so that the convex surface 141 of the elastic piece 14 keeps contacting with the corresponding mechanism of the head band group 2. A buckling point between the convex surface 141 of the elastic piece 14 and the corresponding mechanism of the head band group 2 is obvious and has a better touching feeling. Because the elastic piece 14 is disposed on the retractable adjusting block 1, when the retractable adjusting block 1 slides, the elastic piece 14 moves simultaneously.

Figure 7:
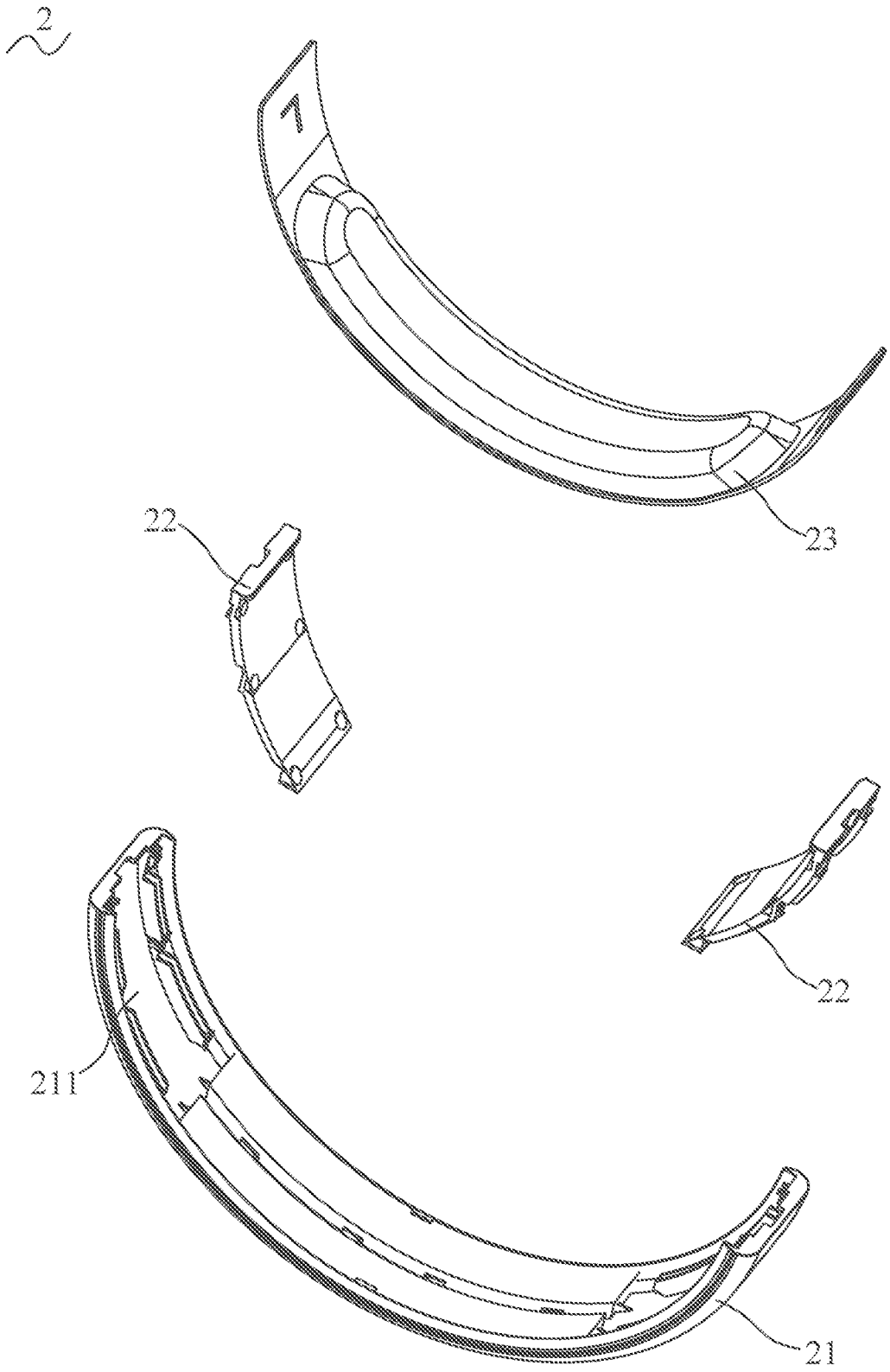
FIG. 7 is an exploded view of a head band group of the head band structure of headset of FIG. 1.
Figure 8:
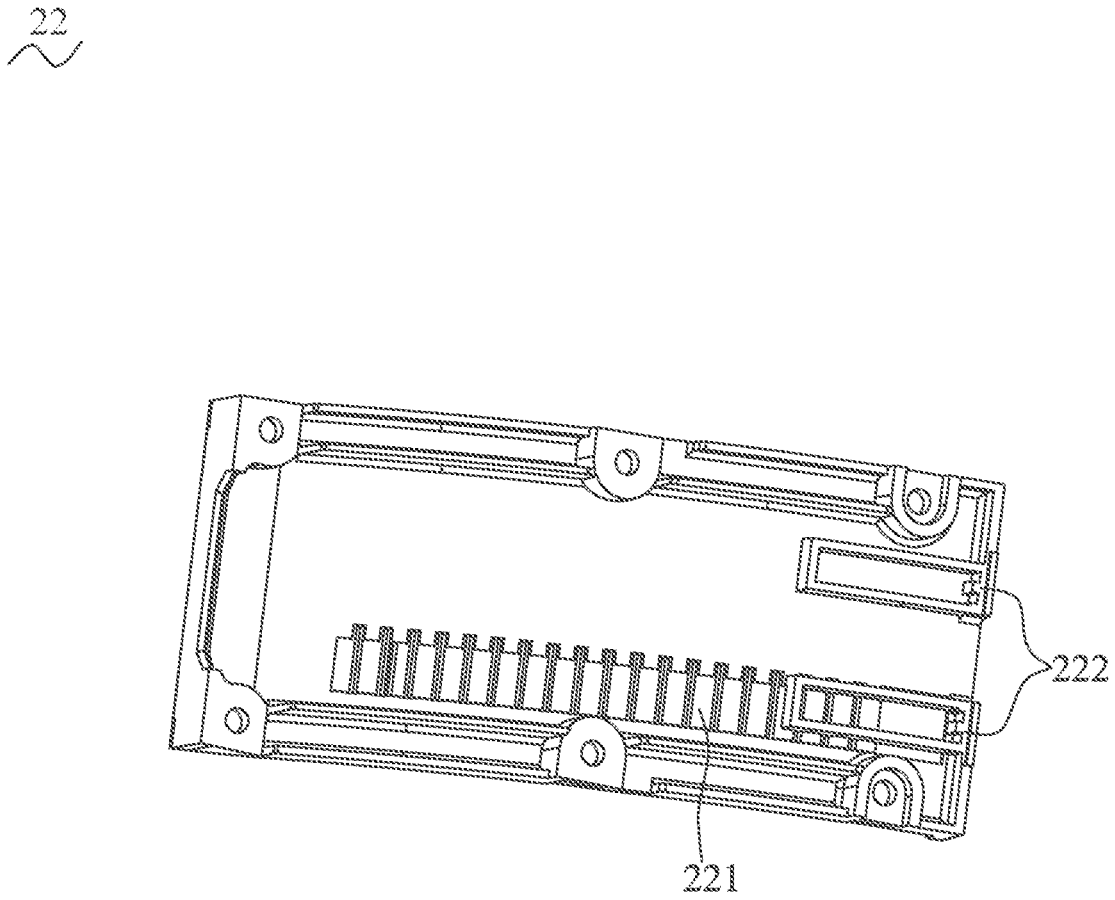
FIG. 8 is a perspective view of a side cover of the head band structure of headset.

Referring to FIG. 7 and FIG. 8, the head band group 2 has a head band 21, two end covers 22 disposed to two opposite ends of the head band 21, and a protecting pad 23. The head band group 2 is of an arc shape. A mouth of the head band group 2 faces frontward. Two opposite ends of an inner surface of the head band 21 are recessed inward to form two sliding grooves 211. The two end covers 22 are disposed to the two sliding grooves 211. The two end covers 22 are attached to the two sliding grooves 211 of the head band 21 by virtue of two locking screws. A gap is formed between each end cover 22 and the head band 21 to make the one end of the retractable adjusting block 1 slide in the space for realizing a pulling and retracting action. An inner surface of the head band 21 faces the two end covers 22. Inner surfaces of the two end covers 22 face the protecting pad 23. The protecting pad 23 is attached to the inner surfaces of the head band 21 and the two end covers 22. An inner surface of the head band group 2 has a waveform locking portion 221 and at least one hollow stopping frame 222. When a user wears the head band structure of headset 100, the protecting pad 23 provides a comfort feeling for the user. A surface of each end cover 22 facing one sliding groove 211 has the waveform locking portion 221, and the at least one hollow stopping frame 222 disposed at one end of the waveform locking portion 221. The surface of each end cover 22 facing the one sliding groove 211 has the two hollow stopping frames 222. The waveform locking portion 221 extends longitudinally along the surface of each end cover 22 and is located at one side of the surface of each end cover 22.

The two hollow stopping frames 222 are protruded from one end of the surface of each end cover 22 and project beyond the surface of each end cover 22. The two hollow stopping frames 222 are spaced from each other. One stopping frame 222 is disposed to and covers one end of the waveform locking portion 221 adjacent to the one end of the surface of each end cover 22. The waveform locking portion 221 contacts with the convex surface 141 of the elastic piece 14. In the preferred embodiment, the elastic piece 14 is disposed to the retractable adjusting block 1. When the retractable adjusting block 1 is adjusted, the protruding portion 157 of the lower cover 15 abuts against an inner surface of a side wall of one sliding groove 211 facing the one end cover 22 and adjacent to the lower cover 15. A pushing force generated at the time of the retractable adjusting block 1 sliding will be decomposed into the friction force and the positive force, the positive force is transmitted to the elastic piece 14 by a structure of the head band structure of headset 100, so that the convex surface 141 of the elastic piece 14 keeps contacting with the waveform locking portion 221 of the one end cover 22, and the buckling point between the convex surface 141 of the elastic piece 14 and the waveform locking portion 221 of the one end cover 22 of the head band group 2 is obvious and has the better touching feeling. The elastic piece 14 is disposed to the retractable adjusting block 1, when the retractable adjusting block 1 slides, the elastic piece 14 moves simultaneously.

Figure 9:
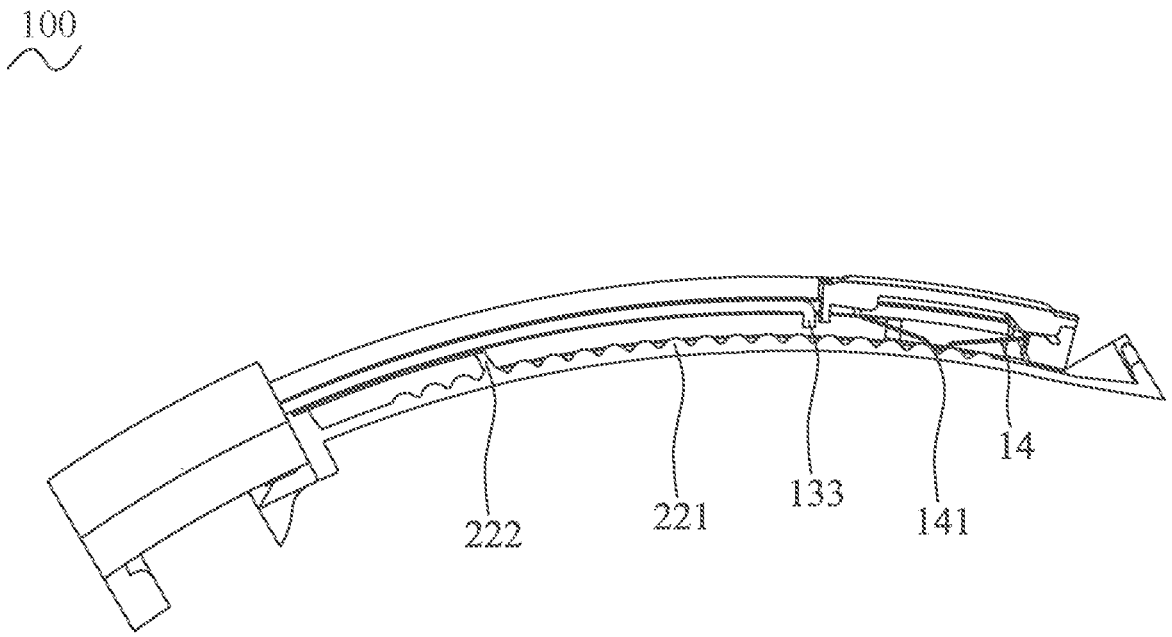
FIG. 9 is a diagrammatic drawing showing a retracting status of the head band structure of headset of FIG. 1.

Referring to FIG. 9, when the head band structure of headset 100 is retracted towards an inside of the head band group 2, the convex surface 141 of the elastic piece 14 keeps contacting with the waveform locking portion 221 of the one end cover 22, a movable distance of the at least one blocking portion 133 is generated between the at least one stopping frame 222 and one end of the inner surface of the head band group 2 away from the at least one stopping frame 222, specifically, a movable distance of the at least one blocking portion 133 is generated between the at least one hollow stopping frame 222 of the one end cover 22 and one end of the surface of the one end cover 22 away from the at least one stopping frame 222 of the one end cover 22, the movable distance of the two blocking portions 133 is generated between the two hollow stopping frames 222 of the one end cover 22 and the one end of the surface of the one end cover 22 away from the two hollow stopping frames 222 of the one end cover 22. The movable distance of the two blocking portions 133 is an adjusting scope of pulling out the retractable adjusting block 1.

Figure 10:
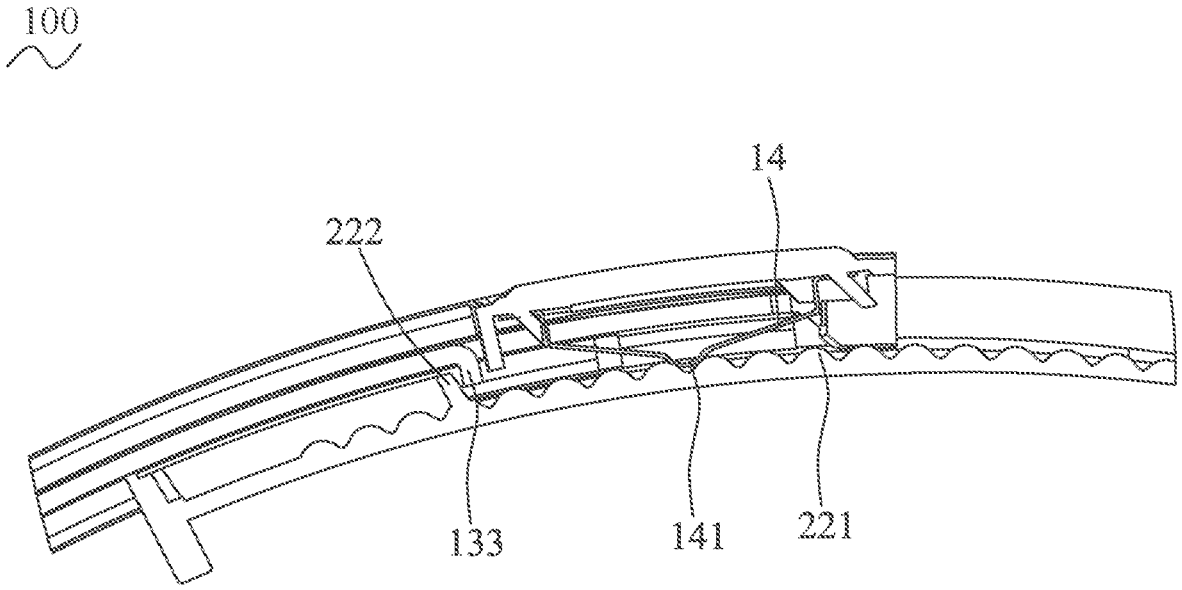
FIG. 10 is a diagrammatic drawing showing a stretching status of the head band structure of headset of FIG. 1.

Referring to FIG. 10, when the head band structure of headset 100 is pulled out from the head band group 2, the convex surface 141 of the elastic piece 14 keeps contacting with the waveform locking portion 221 of the one end cover 22, at the moment, the at least one blocking portion 133 contacts with an inner end of the at least one stopping frame 222 facing the at least one blocking portion 133, the two blocking portions 133 contact with inner ends of the two stopping frames 222 facing the two blocking portions 133, the retractable adjusting block 1 has no way of being pulled out to make the retractable adjusting block 1 be pulled to the furthest position distanced from the head band group 2.

As described above, when the retractable adjusting block 1 is adjusted, the protruding portion 157 of the lower cover 15 rubs against the corresponding mechanism of the head band group 2, the pushing force generated at the time of the retractable adjusting block 1 sliding will be decomposed into the friction force and the positive force, the positive force is transmitted to the elastic piece 14 by the structure of the head band structure of headset 100, so that the convex surface 141 of the elastic piece 14 keeps contacting with the waveform locking portion 221 of the one end cover 22, and the buckling point between the convex surface 141 of the elastic piece 14 and the waveform locking portion 221 of the one end cover 22 of the head band group 2 is obvious and has the better touching feeling. The elastic piece 14 is disposed to the retractable adjusting block 1, when the retractable adjusting block 1 slides, the elastic piece 14 moves simultaneously. Furthermore, when the head band structure of headset 100 is retracted, the convex surface 141 of the elastic piece 14 keeps contacting with the waveform locking portion 221 of the one end cover 22, the movable distance of the two blocking portions 133 is generated between the two hollow stopping frames 222 of the one end cover 22 and the one end of the surface of the one end cover 22 away from the two hollow stopping frames 222 of the one end cover 22, the movable distance of the two blocking portions 133 is the adjusting scope of pulling out the retractable adjusting block 1, when the head band structure of headset 100 is pulled out, the convex surface 141 of the elastic piece 14 keeps contacting with the waveform locking portion 221 of the one end cover 22, at the moment, the two blocking portions 133 contact with the inner ends of the two stopping frames 222 facing the two blocking portions 133, the retractable adjusting block 1 has no way of being pulled out to make the retractable adjusting block 1 be pulled to the furthest position distanced from the head band group 2. As a result, the head band structure of headset 100 is retractable and adjustable.

What is claimed is:

1. A head band structure of headset, comprising:

a retractable adjusting block including an upper cover, a sliding slice, an elastic piece and a lower cover, the elastic piece being disposed to one end of the lower cover, the upper cover being disposed on the lower cover, the sliding slice being disposed between the lower cover and the upper cover, the sliding slice having at least one blocking portion, a substantial middle of the elastic piece being arched upward to form a convex surface; and a head band group connected with one end of the retractable adjusting block, the head band group having a head band, and two end covers disposed to two opposite ends of the head band, a gap being formed between each end cover and the head band to make the one end of the retractable adjusting block slide in the gap, an inner surface of the head band being recessed inward to form two sliding grooves, a surface of each end cover facing one sliding groove having a waveform locking portion, and at least one stopping frame disposed at one end of the waveform locking portion, the convex surface keeping contacting with the waveform locking portion, when the head band structure of headset is retracted, a movable distance of the at least one blocking portion being generated between the at least one stopping frame of one end cover and one end of the surface of the one end cover away from the at least one stopping frame of the one end cover, when the head band structure of headset is pulled out, the at least one blocking portion contacting with an inner end of the at least one stopping frame facing the at least one blocking portion.

2. The head band structure of headset as claimed in claim 1, wherein the elastic piece opens a plurality of locating holes, the lower cover has a plurality of locating pillars, the plurality of the locating pillars pass through the plurality of the locating holes of the elastic piece.

3. The head band structure of headset as claimed in claim 2, wherein each locating hole is of an oval shape, each locating pillar is of an oblique column slantwise extended downward and inward, each locating pillar is located in one locating hole.

4. The head band structure of headset as claimed in claim 2, wherein the convex surface is located among the plurality of the locating holes.

5. The head band structure of headset as claimed in claim 1, wherein the elastic piece opens two locating holes, the lower cover has two locating pillars, the two locating pillars pass through the two locating holes of the elastic piece, each locating hole is of an oval shape, each locating pillar is of an oblique column slantwise extended downward and inward, each locating pillar is located in one locating hole.

6. The head band structure of headset as claimed in claim 5, wherein the convex surface of the elastic piece is located between the two locating holes.

7. The head band structure of headset as claimed in claim 1, wherein the upper cover and the lower cover are of plastic materials.

8. The head band structure of headset as claimed in claim 1, wherein the sliding slice is made of metal material.

9. The head band structure of headset as claimed in claim 1, wherein the lower cover has a protruding portion protruded rearward from a top end of a rear surface of the lower cover, the two end covers are disposed to the two sliding grooves, the protruding portion is disposed to one end of an outer surface of the lower cover, the protruding portion is disposed between the head band and one end cover, the protruding portion abuts against an inner surface of a side wall of one sliding groove facing the one end cover and adjacent to the lower cover.

10. The head band structure of headset as claimed in claim 1, wherein the upper cover has a plurality of first buckling hooks, two second buckling hooks and two third buckling hooks, the sliding slice has a fixing area, the lower cover has a plurality of fourth buckling hooks, two first buckling grooves disposed behind the plurality of the fourth buckling hooks, a second buckling groove opposite to the two first buckling grooves, the plurality of the fourth buckling hooks are buckled in the fixing area, the plurality of the first buckling hooks are buckled in the fixing area, a distance between the plurality of the fourth buckling hooks and the head band group is smaller than a distance between the plurality of the first buckling hooks and the head band group, the two second buckling hooks are buckled in and fastened in the two first buckling grooves, the two third buckling hooks are buckled in and fastened in the second buckling groove.

11. A head band structure of headset, comprising:

a retractable adjusting block including a lower cover, an elastic piece disposed to the lower cover, an upper cover disposed on the lower cover, and a sliding slice disposed between the lower cover and the upper cover, the sliding slice having at least one blocking portion, a substantial middle of the elastic piece being arched upward to form a convex surface; and a head band group receiving one end of the retractable adjusting block, an inner surface of the head band group having a waveform locking portion, and at least one stopping frame disposed at one end of the waveform locking portion, the convex surface keeping contacting with the waveform locking portion, when the head band structure of headset is retracted towards an inside of the head band group, a movable distance of the at least one blocking portion being generated between the at least one stopping frame and one end of the inner surface of the head band group away from the at least one stopping frame, when the head band structure of headset is pulled out from the head band group, the at least one blocking portion contacting with the at least one stopping frame.

12. The head band structure of headset as claimed in claim 11, wherein the upper cover has a plurality of first buckling hooks, two second buckling hooks and two third buckling hooks, the sliding slice has a fixing area, the lower cover has a plurality of fourth buckling hooks, two first buckling grooves disposed behind the plurality of the fourth buckling hooks, a second buckling groove opposite to the two first buckling grooves, the plurality of the fourth buckling hooks are buckled in the fixing area, the plurality of the first buckling hooks are buckled in the fixing area, a distance between the plurality of the fourth buckling hooks and the head band group is smaller than a distance between the plurality of the first buckling hooks and the head band group, the two second buckling hooks are buckled in and fastened in the two first buckling grooves, the two third buckling hooks are buckled in and fastened in the second buckling groove.

13. The head band structure of headset as claimed in claim 12, wherein the elastic piece opens two locating holes, the lower cover has two locating pillars, the two locating pillars pass through the two locating holes of the elastic piece, each locating hole is of an oval shape, each locating pillar is of an oblique column slantwise extended downward and inward, each locating pillar is located in one locating hole.

14. The head band structure of headset as claimed in claim 13, wherein the convex surface of the elastic piece is located between the two locating holes.

15. The head band structure of headset as claimed in claim 11, wherein the lower cover has a protruding portion protruded rearward from a top end of a rear surface of the lower cover, the head band group has a head band, and two end covers disposed to two opposite ends of the head band, two opposite ends of an inner surface of the head band are recessed inward to form two sliding grooves, the two end covers are disposed to the two sliding grooves, the protruding portion is disposed to one end of an outer surface of the lower cover, the protruding portion is disposed between the head band and one end cover, the protruding portion abuts against an inner surface of a side wall of one sliding groove facing the one end cover and adjacent to the lower cover.

16. A head band structure of headset, comprising:

a head band group having a head band, and two end covers disposed to two opposite ends of the head band, a gap being formed between each end cover and the head band to make one end of the retractable adjusting block slide in the gap, two opposite ends of an inner surface of the head band being recessed inward to form two sliding grooves, a surface of each end cover facing one sliding groove having a waveform locking portion, and at least one stopping frame disposed at one end of the waveform locking portion; and a retractable adjusting block telescopically connected with one end of the head band group, including a cover assembly, a sliding slice disposed in the cover assembly and having at least one blocking portion, and an elastic piece disposed to one end of the cover assembly, a substantial middle of the elastic piece being arched upward to form a convex surface, wherein when the head band structure of headset is retracted, a movable distance of the at least one blocking portion is generated between the at least one stopping frame of one end cover and one end of the surface of the one end cover away from the at least one stopping frame of the one end cover, when the head band structure of headset is pulled out, the at least one blocking portion contacts with an inner end of the at least one stopping frame facing the at least one blocking portion, the convex surface keeping contacting with the waveform locking portion.

* * * * *